US010226942B2

(12) United States Patent
Hasegawa et al.

(10) Patent No.: US 10,226,942 B2
(45) Date of Patent: Mar. 12, 2019

(54) PRINTER, METHOD OF CONTROLLING PRINTER, AND STORAGE MEDIUM

(71) Applicant: CASIO COMPUTER CO., LTD., Tokyo (JP)

(72) Inventors: Hirokazu Hasegawa, Tokyo (JP); Toshiaki Kanamura, Tokyo (JP); Yoshimasa Yokoyama, Tokyo (JP); Yasushi Murai, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/933,241

(22) Filed: Mar. 22, 2018

(65) Prior Publication Data

US 2018/0272748 A1 Sep. 27, 2018

(30) Foreign Application Priority Data

Mar. 23, 2017 (JP) ..... 2017-057464

(51) Int. Cl.
*B41J 2/355* (2006.01)
*B41J 29/38* (2006.01)

(52) U.S. Cl.
CPC ..... *B41J 2/3558* (2013.01); *B41J 2/355* (2013.01); *B41J 29/38* (2013.01)

(58) Field of Classification Search
CPC ..... B41J 2/355; B41J 2/3558; B41J 2/3352; B41J 2/04501; B41J 2/04541; B41J 2/04548; B41J 2/0455; B41J 2/2103; B41J 29/38
See application file for complete search history.

(56) References Cited

U.S. PATENT DOCUMENTS 5,852,369 A * 12/1998 Katsuma ..... B41J 2/33515 324/678
5,940,097 A * 8/1999 Imai ..... B41J 2/1752 340/500
2001/0048291 A1* 12/2001 Lautzenhiser ..... G05B 11/42 323/234
2007/0132795 A1* 6/2007 Han ..... B41J 29/393 347/9
2012/0080947 A1* 4/2012 Karino ..... H02J 1/14 307/31

FOREIGN PATENT DOCUMENTS

JP H5-77526 A 3/1993
JP 2003-102167 A 4/2003
JP 2008-283498 A 11/2008
JP 2012-078458 A 4/2012
JP 2014-090637 A 5/2014

* cited by examiner

*Primary Examiner* — Geoffrey S Mruk
*Assistant Examiner* — Scott A Richmond
(74) *Attorney, Agent, or Firm* — Chen Yoshimura LLP

(57) ABSTRACT

A printer includes a processor; a thermal head driver circuit that drives a thermal head for printing on a printing medium; a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, wherein the processor, when stopping operation of the printer, performs a control process of discharging the capacitor via the motor driver circuit and the motor.

11 Claims, 13 Drawing Sheets

PRINTER, METHOD OF CONTROLLING PRINTER, AND STORAGE MEDIUM

BACKGROUND OF THE INVENTION

The present specification relates to a printer, a method of controlling the printer, and a storage medium.

DESCRIPTION OF THE RELATED ART

One conventionally well-known technology in the field of thermal printers is variable division printing. In variable division printing technologies, when the number of heating elements through which current should be passed to print a single line exceeds a prescribed number, divided printing is performed by dividing the single printing line into a plurality of blocks and then printing each block in a time-divided manner, whereas when the number of heating elements through which current should be passed to print a single line does not exceed the prescribed number, one-time printing is performed by printing the entire single printing line at once. Using such a variable division printing technology makes it possible to work around the power supply capacity limitations of AC adapters.

However, using divided printing for a printing line increases the time required to print the printing line and thus decreases printing speed in comparison to when using one-time printing. Therefore, thermal printers that use a high-capacitance capacitor to make it possible to supply currents requiring power of a greater magnitude than the power supply capacity of the AC adapter in order to support high-speed printing have also been proposed. Such technologies are described in a patent document (Japanese Patent Application Laid-Open Publication No. H5-77526), for example.

However, when using a high-capacitance capacitor, inrush current of a relatively large magnitude occurs when voltage is applied to the capacitor. In light of the foregoing, one aspect of the present invention aims to provide a technology for achieving high-speed printing while also reducing the occurrence of inrush currents of large magnitude.

SUMMARY OF THE INVENTION

Accordingly, the present invention is directed to a scheme that substantially obviates one or more of the problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a printer, including: a processor; a thermal head driver circuit that drives a thermal head for printing on a printing medium; a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, wherein the processor, when stopping operation of the printer, performs a control process of discharging the capacitor via the motor driver circuit and the motor.

In another aspect, the present disclosure provides a method of controlling a printer performed by a processor in the printer, the printer including the processor; a thermal head driver circuit that drives a thermal head for printing on a printing medium; a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, the method including: receiving an instruction to stop operation of the printer; and performing a control process of discharging the capacitor via the motor driver circuit and the motor upon the receipt of the instruction to stop operation of the printer.

In another aspect, the present disclosure provides a non-transitory computer-readable storage medium having stored a program executable by a processor in a printer that includes the processor; a thermal head driver circuit that drives a thermal head for printing on a printing medium; a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, the program causing the processor to execute the following processes: receiving an instruction to stop operation of the printer; and performing a control process of discharging the capacitor via the motor driver circuit and the motor upon the receipt of the instruction to stop operation of the printer.

It is to be understood that both the foregoing general description and the following detailed description are exemplary and explanatory, and are intended to provide further explanation of the invention as claimed.

DETAILED DESCRIPTION OF THE INVENTION

Embodiment 1

Figure 1:
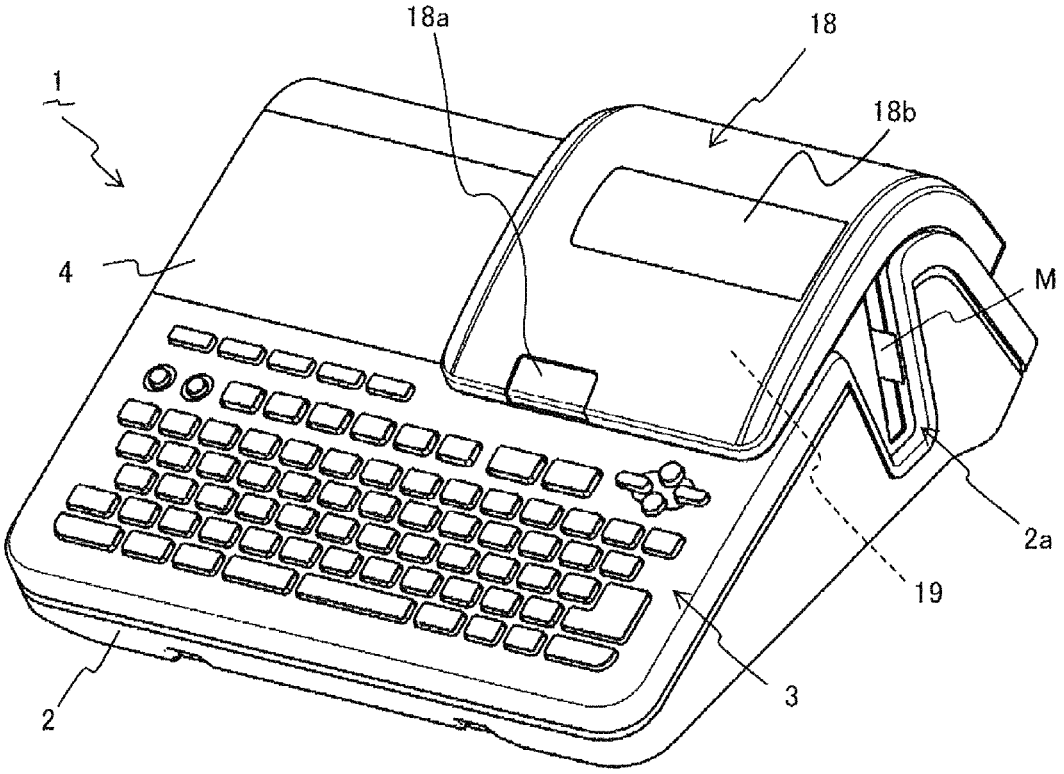
FIG. 1 is a perspective view of a printer 1.

FIG. 1 is a perspective view of a printer 1 according to Embodiment 1. The printer 1 includes a thermal head for printing on a printing medium and is a label printer which prints on an elongated printing medium M using a single-pass scheme, for example. Although a thermal transfer label printer which uses an ink ribbon will be described below as an example, the printing scheme is not particularly limited. For example, a thermal printing scheme which uses thermal paper may be used. The printing medium M is a tape including a base material which has an adhesive layer, and a release paper which is peelably adhered to the base material so as to cover the adhesive layer, for example. The printing medium M may also be a tape that does not include release paper.

As illustrated in FIG. 1, the printer 1 includes a housing 2, an input unit 3, a display unit 4, an opening/closing lid 18, and a cassette compartment 19. The input unit 3, the display unit 4, and the opening/closing lid 18 are arranged on the top surface of the housing 2. Moreover, the housing 2 includes various components that are not illustrated in the figure, such as a power cord connection terminal, an external device connection terminal, and a storage media insertion port.

The input unit 3 includes various keys such as input keys, directional keys, conversion keys, and an enter key. The display unit 4 is a liquid crystal display panel, for example, and displays text and the like corresponding to input from the input unit 3, selection menus for various settings, messages related to various processes, and the like. Moreover, during printing, the display unit 4 displays the content (hereinafter, "printing content") such as text and graphics which was specified to be printed on the printing medium M and may also display the progress of the printing process. Furthermore, the display unit 4 may include a touch panel unit, in which case the display unit 4 may be regarded as being part of the input unit 3. In addition, the display unit 4 may display prescribed messages when abnormalities are detected in the printer 1 in order to notify the user of the abnormalities in the printer 1. In other words, the display unit 4 is a notification unit which issues notifications of abnormalities in the printer 1.

The opening/closing lid 18 is openably/closably arranged on top of the cassette compartment 19. The opening/closing lid 18 can be opened by pressing a button 18*a*. A window 18*b* is formed in the opening/closing lid 18 in order to make it possible to visually check whether a tape cassette 30 (see FIG. 2) is currently housed in the cassette compartment 19 even when the opening/closing lid 18 is closed. Moreover, a feedout port 2*a* is formed in the side face of the housing 2. The printing medium M that is printed on inside of the printer 1 is fed to outside of the device via this feedout port 2*a*.

Figure 2:
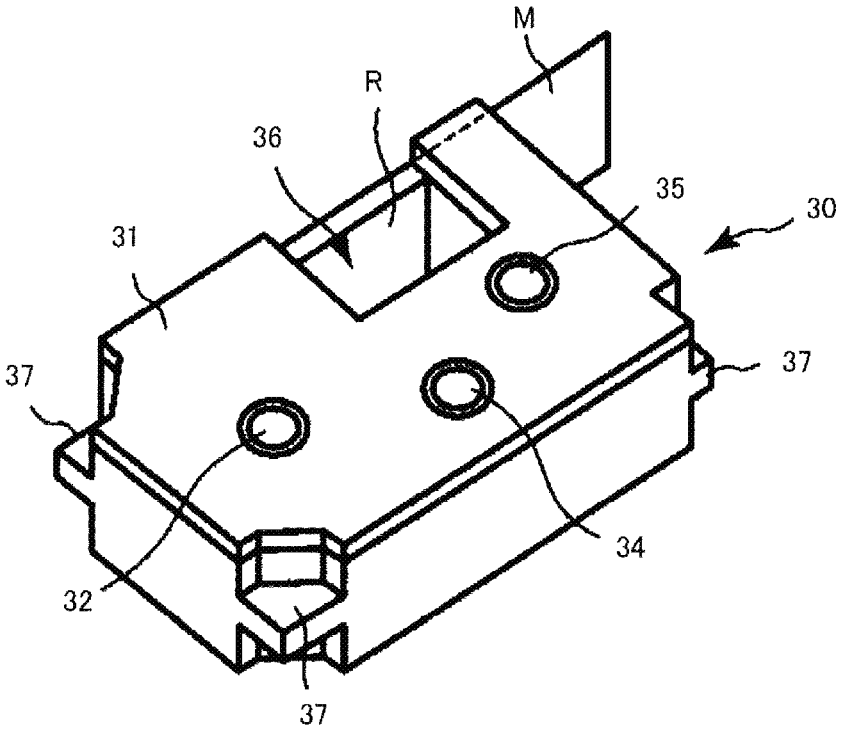
FIG. 2 is a perspective view of a tape cassette 30 housed in the printer 1.
Figure 3:
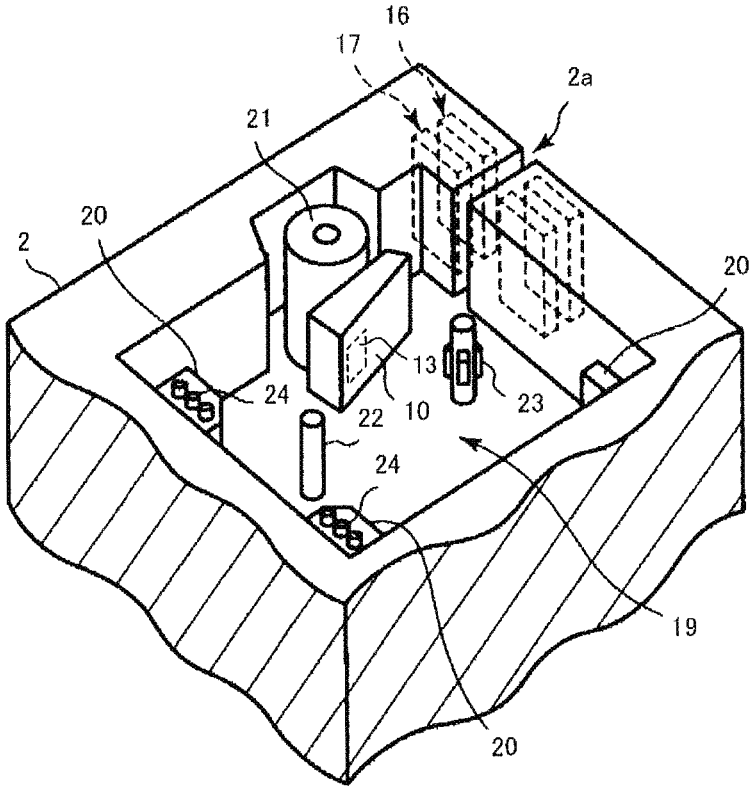
FIG. 3 is a perspective view of a cassette compartment 19 of the printer 1.
Figure 4:
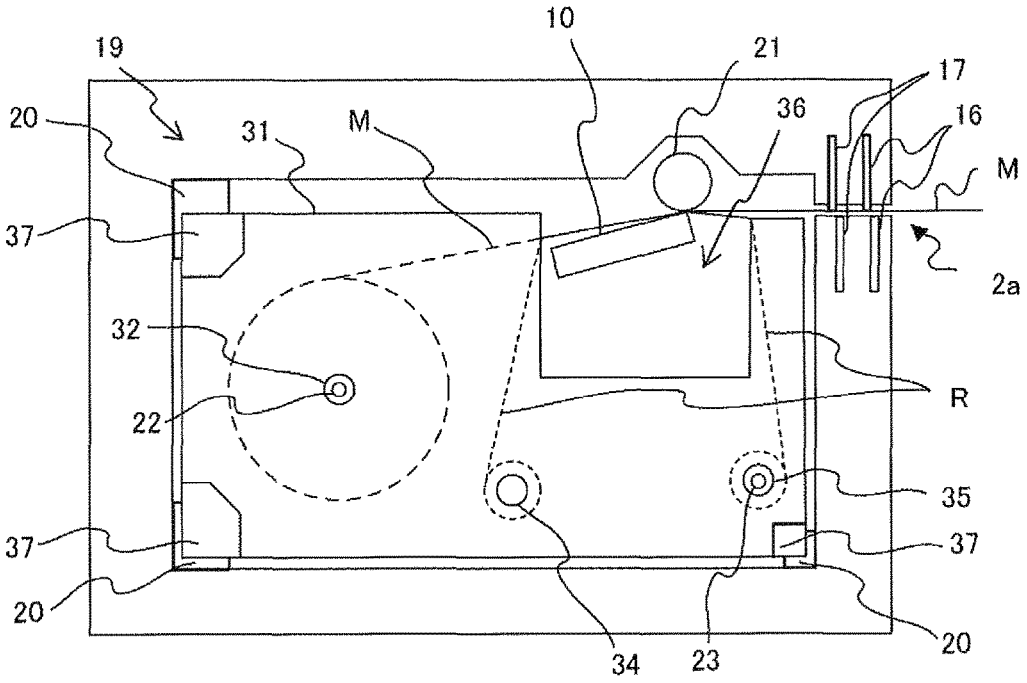
FIG. 4 is a cross-sectional view of the printer 1.

FIG. 2 is a perspective view of the tape cassette 30 housed in the printer 1. FIG. 3 is a perspective view of the cassette compartment 19 of the printer 1. FIG. 4 is a cross-sectional view of the printer 1. The tape cassette 30 illustrated in FIG. 2 is removably housed within the cassette compartment 19 illustrated in FIG. 3. FIG. 4 depicts a state in which the tape cassette 30 is housed within the cassette compartment 19.

As illustrated in FIG. 2, the tape cassette 30 includes a cassette case 31 which stores the printing medium M and an ink ribbon R and in which a thermal head insertion portion 36 and engagement portions 37 are formed. The cassette case 31 includes a tape core 32, an ink ribbon supply core 34, and an ink ribbon winding core 35. The printing medium M is wound in a roll around the tape core 32 inside of the cassette case 31. Moreover, the thermal transfer ink ribbon R is wound in a roll around the ink ribbon supply core 34 inside of the cassette case 31, with the leading end being wound around the ink ribbon winding core 35.

As illustrated in FIG. 3, a plurality of cassette-receiving portions 20 for supporting the tape cassette 30 at prescribed positions are formed inside of the cassette compartment 19 in the housing 2. Moreover, tape width detection switches 24 for detecting the width of the tape (the printing medium M) stored in the tape cassette 30 are provided on the cassette-receiving portions 20. The tape width detection switches 24 are a width detection unit which detects the width of the printing medium M on the basis of the shape of the cassette.

Furthermore, a thermal head 10 which includes a plurality of heating elements and prints on the printing medium M, a platen roller 21 (a conveying unit which conveys the printing medium M), a tape core-engaging axle 22, and an ink ribbon winding driver axle 23 are arranged inside of the cassette compartment 19. In addition, thermistors 13 are embedded in the thermal head 10. The thermistors 13 are a head temperature measuring unit which measures the temperature of the thermal head 10.

As illustrated in FIG. 4, when the tape cassette 30 is housed within the cassette compartment 19, the engagement portions 37 formed in the cassette case 31 are supported by the cassette-receiving portions 20 formed in the cassette compartment 19, and the thermal head 10 is inserted into the thermal head insertion portion 36 formed in the cassette case 31. Moreover, the tape core 32 of the tape cassette 30 is fitted onto the tape core-engaging axle 22, and the ink ribbon winding core 35 is fitted onto the ink ribbon winding driver axle 23.

Once a printing instruction is input to the printer 1, the printing medium M is drawn out from the tape core 32 by the rotation of the platen roller 21. Here, the ink ribbon winding driver axle 23 rotates in sync with the platen roller 21 so that the ink ribbon R is drawn out from the ink ribbon supply core 34 in unison with the printing medium M. In this way, the printing medium M and the ink ribbon R are conveyed along in an overlapping manner. Then, the thermal head 10 heats the ink ribbon R as the ink ribbon R passes between the thermal head 10 and the platen roller 21 in order to transfer the ink onto the printing medium M and thereby print on the printing medium M.

The used ink ribbon R that has passed between the thermal head 10 and the platen roller 21 is then wound around the ink ribbon winding core 35. Meanwhile, the printed printing medium M that has passed between the thermal head 10 and the platen roller 21 is cut by a half-cutting mechanism 16 or a full-cutting mechanism 17 and then fed out through the feedout port 2*a*.

Figure 5:
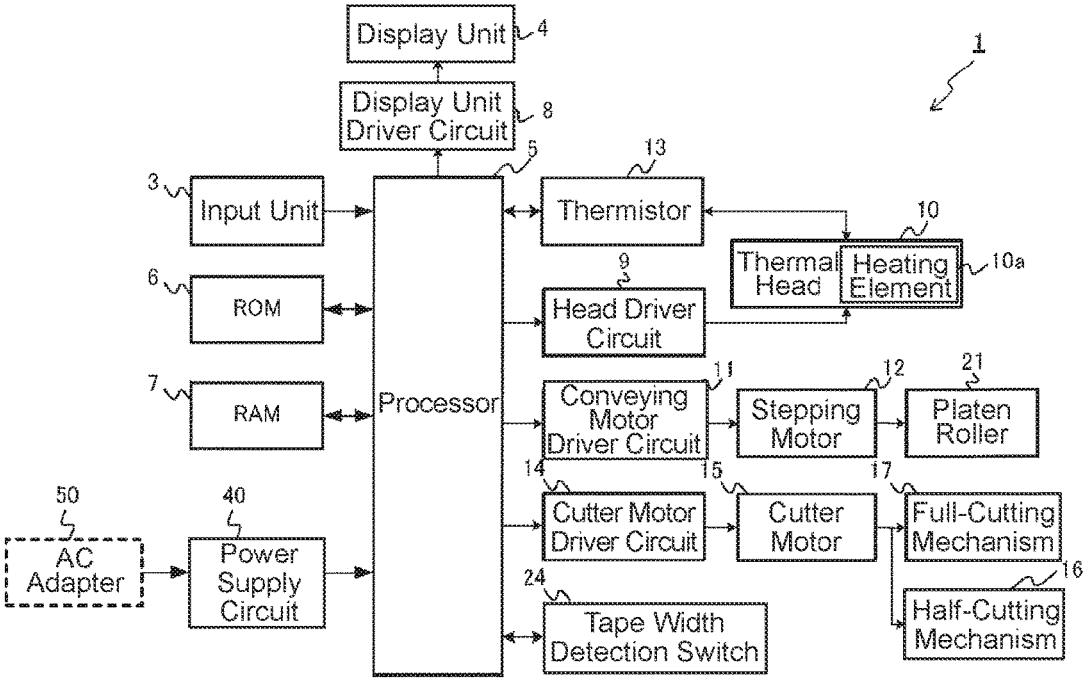
FIG. 5 is a block diagram illustrating a hardware configuration of the printer 1.

FIG. 5 is a block diagram illustrating a hardware configuration of the printer 1. The printer 1 includes, in addition to the input unit 3, the display unit 4, the thermal head 10, the thermistors 13, the half-cutting mechanism 16, the full-cutting mechanism 17, the platen roller 21, and the tape width detection switches 24 described above, a processor 5, a read-only memory (ROM) 6, a random-access memory (RAM) 7, a display unit driver circuit 8, a head driver circuit (thermal head driver circuit) 9, a conveying motor driver circuit 11, a stepping motor 12, a cutter motor driver circuit 14, a cutter motor 15, and a power supply circuit 40. Here, at least the processor 5, the ROM 6, and the RAM 7 form a computer of the printer 1.

The processor 5 includes a central processing unit (CPU) or the like, for example, and transfers programs stored in the ROM 6 to the RAM 7 and then executes those programs in order to control the operation of the components of the printer 1.

The processor 5 supplies a strobe signal, printing data, and strategy data, for example, to the head driver circuit 9 and controls the thermal head 10 via the head driver circuit 9. Moreover, the processor 5 controls switching circuits 43 and 45 and also controls the motors (the stepping motor 12 and the cutter motor 15) via the motor driver circuits (the conveying motor driver circuit 11 and the cutter motor driver circuit 14).

The ROM 6 stores printing programs for printing on the printing medium M and various types of data needed to execute the printing programs (such as fonts, for example). The ROM 6 also functions as a storage medium which stores programs readable by the processor 5. The RAM 7 includes a printing data storage unit which stores data (hereinafter, "printing data") representing patterns for printing content. The RAM 7 also includes a display data storage unit which stores display data.

The display unit driver circuit 8 controls the display unit 4 in accordance with the display data stored in the RAM 7. Under the control of the display unit driver circuit 8, the display unit 4 may display the printing content in a manner which makes the progress of the printing process visible, for example.

The head driver circuit 9 is a head driver which drives the thermal head 10 on the basis of the strobe signal and the printing data supplied from the processor 5. More specifically, during a current-conducting period in which the strobe signal is ON, the head driver circuit 9 causes current to be passed or not be passed through a plurality of heating elements 10*a* on the basis of the printing data.

The thermal head 10 is a printhead which includes the plurality of heating elements 10*a* arranged in a primary scanning direction. During the current-conducting period of the strobe signal supplied from the processor 5, the head driver circuit 9 selectively passes current through the heating elements 10*a* in accordance with the printing data, thereby causing the heating elements 10*a* to generate heat and apply that heat to the ink ribbon R. In this way, the thermal head 10 prints on the printing medium M one line at a time by means of thermal transfer. In other words, the printer 1 is a thermal line printer.

The conveying motor driver circuit 11 drives the stepping motor 12. The stepping motor 12 rotates the platen roller 21. The platen roller 21 is a conveyor which rotates using the power supplied by the stepping motor 12 in order to convey the printing medium M in the lengthwise direction (a secondary scanning direction) of that printing medium M.

The cutter motor driver circuit 14 drives the cutter motor 15. The half-cutting mechanism 16 and the full-cutting mechanism 17 operate using the power supplied by the cutter motor 15 to make half cuts or full cuts in the printing medium M. Here, a "full cut" refers to cutting through both the base material and the release paper of the printing medium M in the width direction, while a "half cut" refers to cutting through just the base material in the width direction.

The power supply circuit 40 generates an output voltage from a DC voltage (24V, for example) from an AC adapter 50 and supplies power to the components of the printer 1.

Figure 6:
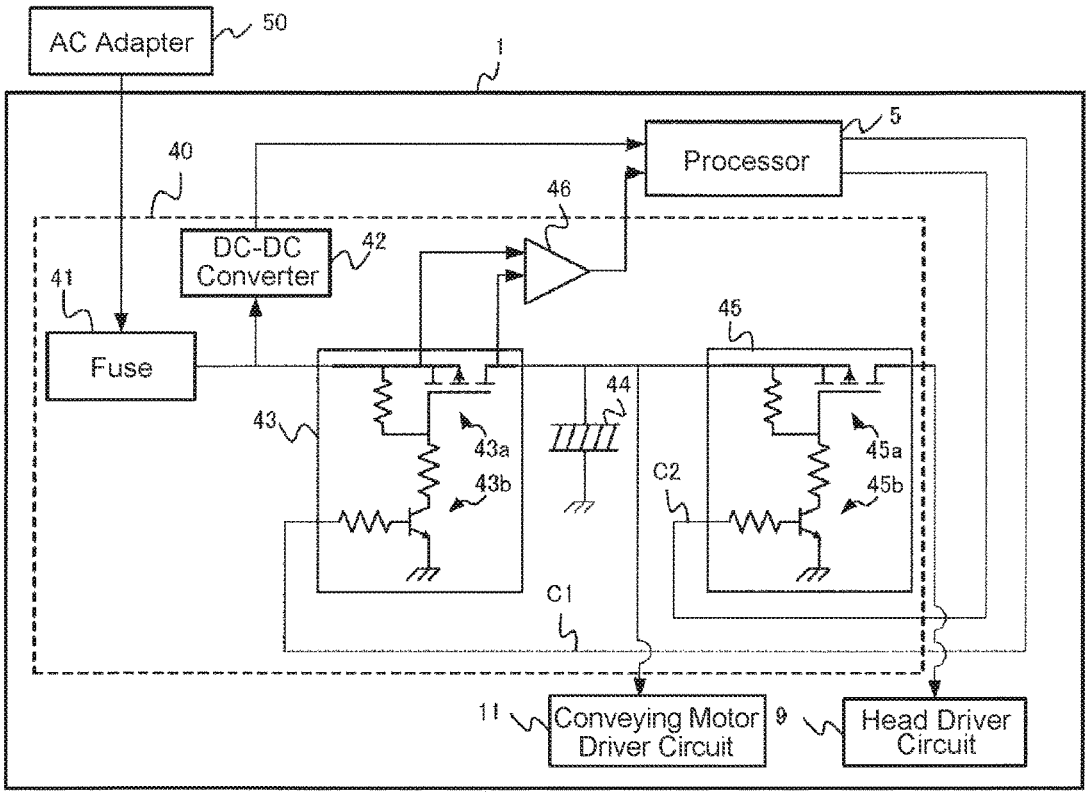
FIG. 6 is a block diagram illustrating a configuration of a power supply circuit 40 of the printer 1.

FIG. 6 is a block diagram illustrating a configuration of the power supply circuit 40 of the printer 1. Note that although FIG. 6 depicts an example in which the power supply circuit 40 is supplying power to the processor 5, the head driver circuit 9, and the conveying motor driver circuit 11, the power supply circuit 40 may also supply power to the other driver circuits.

As illustrated in FIG. 6, the power supply circuit 40 includes a fuse 41, a DC-DC converter 42, the switching circuit 43, a capacitor 44, the switching circuit 45, and an op-amp 46.

The DC-DC converter 42 steps down the output voltage input from the AC adapter 50 via the fuse 41 and supplies the resulting voltage to the processor 5.

The switching circuit 43 is a first switching circuit which includes a MOSFET 43*a* and a transistor 43*b*, and is supplied with a control signal C1 from the processor 5. Due to including semiconductor switching devices (the MOSFET 43*a* and the transistor 43*b*), the switching circuit 43 can be switched at high speeds. The switching circuit 43 is controlled by the processor 5 for the primary purpose of reducing the occurrence of inrush currents of relatively large magnitude to the capacitor 44.

The capacitor 44 is an electrolytic capacitor and primarily serves the purpose of supplying currents requiring power of greater magnitude than the power supply capacity of the AC adapter. The capacitor 44 has a large capacitance, such as 4700 μF. It is preferable that the capacitor 44 be arranged between the both conveying motor driver circuit 11 and head driver circuit 9, and the switching circuit 43. This arrangement makes it possible to reliably discharge any charge stored in the capacitor 44 after the printing process is completed.

The switching circuit 45 is a second switching circuit which includes a MOSFET 45*a* and a transistor 45*b*, and is supplied with a control signal C2 from the processor 5. Due to including semiconductor switching devices (the MOSFET 45*a* and the transistor 45*b*), the switching circuit 45 can be switched at high speeds. The switching circuit 45 is included primarily to avoid application of voltage to the thermal head 10 (and the head driver circuit 9) when the thermal head 10 is not in use. It is preferable that the switching circuit 45 be arranged between the both conveying motor driver circuit 11 and switching circuit 43, and the head driver circuit 9. This arrangement makes it possible to reduce propagation of noise from the head driver circuit 9, which experiences larger currents than the conveying motor driver circuit 11 and can generate noise as a result, for example, to the conveying motor driver circuit 11. This, in turn, makes it possible to prevent the stepping motor 12 from stepping-out due to such noise.

The op-amp 46 is an amplifier circuit for amplifying the voltage drop caused by the switching circuit 43 (more specifically, between the source and drain). The op-amp 46 is provided primarily to measure the current flowing through the switching circuit 43. The output from the op-amp 46 is input to the processor 5.

The processor 5 controls the power supply circuit 40 configured as described above and thereby controls the operation of the stepping motor 12 and the thermal head 10.

When starting operation of the stepping motor 12, for example, the processor 5 controls the switching circuit 43 so as to alternately switch the supply of current to the capacitor 44 on and off in order to reduce the occurrence of inrush currents of relatively large magnitude.

More specifically, the processor 5 changes the level of the control signal C1 supplied to the switching circuit 43 to an H level in order to supply current to the base of the transistor 43*b*. This switches the transistor 43*b* ON and causes current to flow to the collector of the transistor 43*b*. Due to this, a voltage of greater than the threshold value is applied between the gate and source of the MOSFET 43*a*, which causes the MOSFET 43*a* to switch ON. As a result, current is supplied to the capacitor 44. Moreover, when the processor 5 changes the level of the control signal C1 to an L level, the transistor 43*b* switches OFF. Due to this, the gate and source of the MOSFET 43*a* take the same voltage, which causes the MOSFET 43*a* to switch OFF. As a result, the supply of current to the capacitor 44 is cut off. By performing a pulse-modulation control process of switching the level of the control signal C1 between the H level and the L level, the processor 5 inhibits flow of inrush currents of relatively large magnitude to the capacitor 44 when operation of the stepping motor 12 is started, thereby making it possible to avoid malfunctions and the like in the device. Here, the pulse-modulation control process performed by the processor 5 is a PWM control process, for example.

When stopping operation of the stepping motor 12 after an operation for stopping the printer 1 is performed, for example, the processor 5 may change the operation mode of the conveying motor driver circuit 11 to a braking mode in order to discharge any charge stored in the capacitor 44 via the conveying motor driver circuit 11 and the stepping motor 12.

More specifically, when such an operation for stopping the printer 1 is performed, the processor 5 first changes the level of the control signal C1 to the L level in order to switch OFF the transistor 43*b* and the MOSFET 43*a*. This causes the capacitor 44 to enter a state in which charging is stopped. Then, the processor 5 changes the operation mode of the conveying motor driver circuit 11 to the braking mode, thereby stopping the stepping motor 12 in a current-conducting state. As a result, current flows from the capacitor 44 to the stepping motor 12 via the conveying motor driver circuit 11, thereby making it possible to discharge any charge stored in the capacitor 44.

The processor 5 may control the switching circuit 45 in accordance with the operation of the thermal head 10, for example.

More specifically, during periods of driving the stepping motor 12 (that is, while the MOSFET 43*a* of the switching circuit 43 is ON), the processor 5 controls the ON/OFF switching of the switching circuit 45 in accordance with the driving timings of the thermal head 10, thereby making it possible to prevent voltage from being unnecessarily applied to the thermal head 10. This makes it possible to avoid failure of the thermal head 10 and extend the lifespan of the thermal head 10.

Furthermore, the processor 5 may monitor the printer 1 on the basis of the output signal from the op-amp 46.

For example, the processor 5 may detect for abnormalities in the printer 1 on the basis of the output signal from the op-amp 46, and when an abnormality is detected, the processor 5 may make the notification unit issue a notification of the abnormality in the printer 1.

More specifically, the processor 5 calculates the drain current value flowing through the switching circuit 43 on the basis of the output signal (a voltage value) from the op-amp 46 and the source-drain resistance of the MOSFET 43*a* of the switching circuit 43. Note that if the temperature of the switching circuit 43 can be measured, the processor 5 may calculate the drain current value on the basis of the voltage value, the resistance of the switching circuit 43, and the measured temperature. Then, if the drain current value is excessively large, this suggests that the device has malfunctioned due to a short-circuit or the like, so the processor 5 determines that the printer 1 is in an abnormal state and detects an abnormality in the printer 1. Next, the processor 5 makes the display unit 4 (the notification unit) display a prescribed message, for example, to notify the user of the abnormality in the printer 1. This make it possible for the user to ascertain that an abnormality has occurred in the printer 1.

The processor 5 may, on the basis of the output signal from the op-amp 46, calculate total power consumption in terms of the total power supplied to the power supply circuit 40 and may then control the operation of the printer 1 in accordance with the state of the printer 1 as predicted on the basis of this total power consumption, for example.

More specifically, the processor 5 calculates power consumption per unit time on the basis of the elapsed time, the output voltage value from the AC adapter 50, and the current value calculated on the basis of the output signal (voltage value) from the op-amp 46, and then the processor 5 calculates the total power consumption on the basis of the time intervals at which those power consumption values are calculated. Then, the processor 5 predicts the temperature of the thermal head 10, for example, on the basis of this total power consumption and then temporarily suspends or completely stops the printing process in accordance with the predicted temperature, for example. This makes it possible to prevent failure of the thermal head 10 in advance as well as to extend the lifespan of the thermal head 10.

Figure 7:
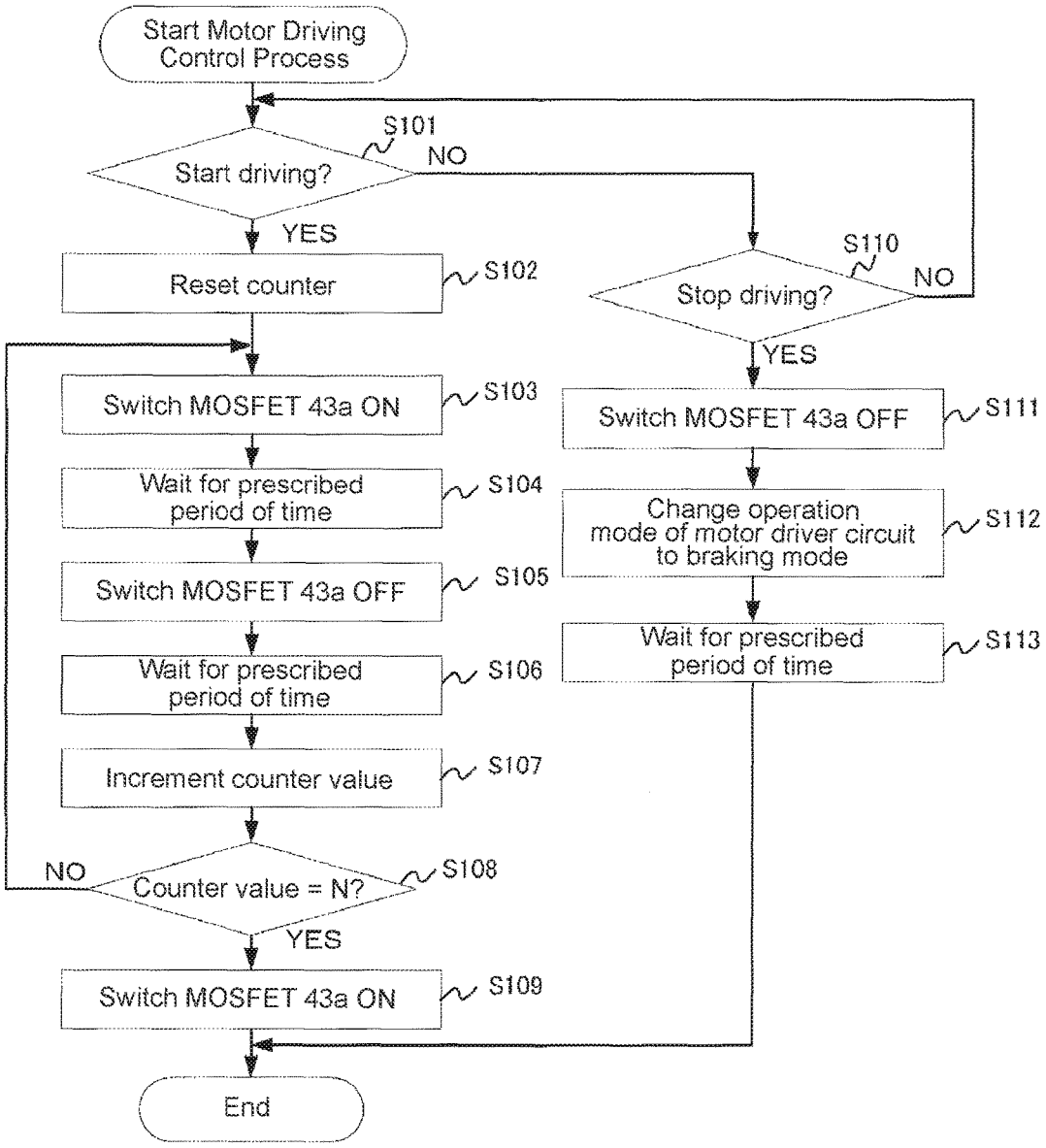
FIG. 7 is a flowchart of a motor driving control process.
Figure 8:
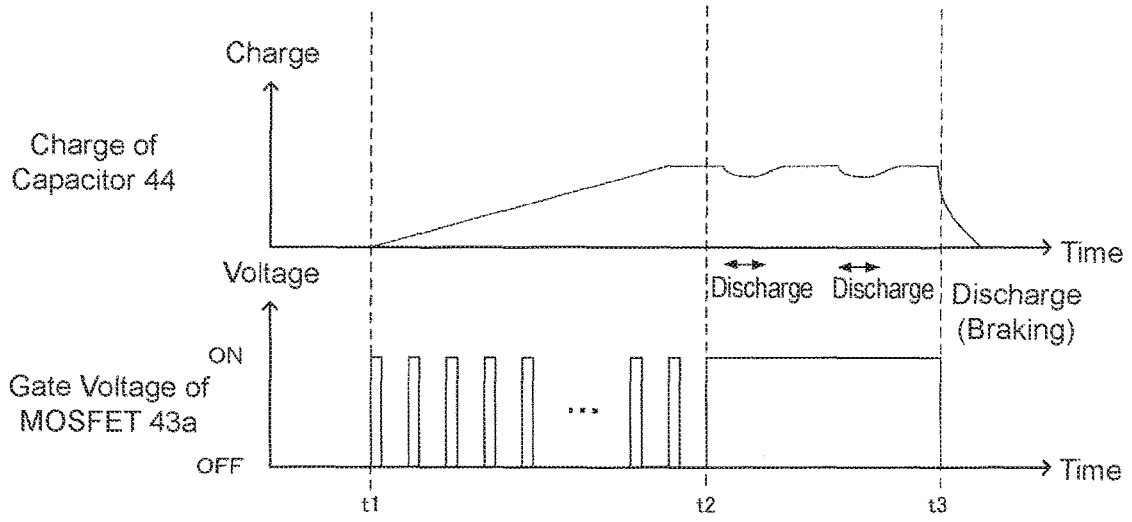
FIG. 8 is a timing chart showing the charge stored in a capacitor 44 and the gate voltage of a MOSFET 43*a*.

FIG. 7 is a flowchart of a motor driving control process. FIG. 8 is a timing chart showing the charge stored in the capacitor 44 and the gate voltage of the MOSFET 43*a*. Next, the motor driving control process performed by the processor 5 will be described in detail with reference to FIGS. 6 to 8.

Once printing data is input and an instruction to start printing is received, the processor 5 determines that an instruction to start driving the motors has been received (YES in step S101), and then the processor 5 resets a counter provided therein (step S102).

Next, the processor 5 changes the level of the control signal C1 to the H level in order to switch ON the MOSFET 43*a* (step S103) and then waits for a prescribed period of time (step S104). Then, the processor 5 changes the level of the control signal C1 to the L level in order to switch OFF the MOSFET 43*a* (step S105) and then once again waits for a prescribed period of time (step S106). Here, the prescribed period of time in step S104 and the prescribed period of time in step S106 may be the same or may be different.

Next, the processor 5 increments the value of the counter (hereinafter, the "counter value") that was reset in step S102 (step S107) and then determines whether the counter value has reached a prescribed value N (step S108).

If the counter value has not yet reached the prescribed value N (NO in step S108), the processor 5 repeats the processes of step S103 to step S108 until the counter value reaches the prescribed value N. Thus, as illustrated from time t1 to time t2 in FIG. 8, a pulse voltage of a prescribed fixed frequency is applied to the gate of the MOSFET 43*a*, and charge is gradually stored in the capacitor 44. This inhibits flow of inrush currents of relatively large magnitude to the capacitor 44.

Then, once the counter value reaches the prescribed value N (YES in step S108), the processor 5 switches ON the MOSFET 43*a* (step S109). Thus, as illustrated from time t2 to time t3 in FIG. 8, the MOSFET 43*a* is kept in the ON state and power continues to be supplied to the motors until an instruction to stop driving the motors is input.

When an operation for stopping the printer 1 is performed and it is time to stop driving the motors (YES in step S110), the processor 5 first switches OFF the MOSFET 43*a* (step S111) to stop the supply of power from the AC adapter 50.

Next, the processor 5 changes the operation mode of the conveying motor driver circuit 11 to the braking mode (step S112). As a result, the conveying motor driver circuit 11 brakes the stepping motor 12 and causes the operation of the stepping motor 12 to stop. Then, the processor 5 waits for a prescribed period of time (step S113). During this time, the stepping motor 12 still consumes current in order to generate a self-holding torque, and therefore current flows from the capacitor 44 to the stepping motor 12 via the conveying motor driver circuit 11, and the charge stored in the capacitor 44 is discharged by flowing to the stepping motor 12 via the conveying motor driver circuit 11. This makes it possible to reliably discharge any charge stored in the capacitor 44 after the printing process is completed and operation of the motors is stopped.

Figure 9:
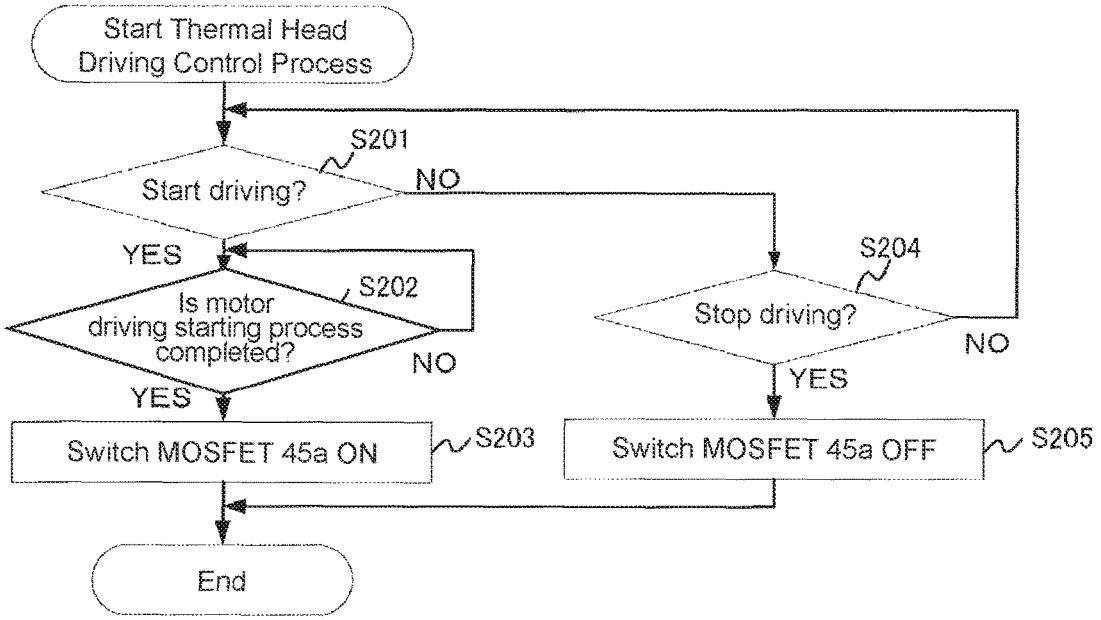
FIG. 9 is a flowchart of a thermal head driving control process.

FIG. 9 is a flowchart of a thermal head driving control process. Next, the thermal head driving control process performed by the processor 5 will be described in detail with reference to FIGS. 6, 8, and 9.

Once an instruction to start driving the thermal head 10 is received (YES in step S201), the processor 5 determines whether the motors have started operating (step S202). More specifically, the processor 5 determines whether the processes of step S101 to step S109 in FIG. 7 have been completed such that the stepping motor 12 is now being continuously supplied with current. In other words, in step S202 the processor 5 determines whether the device is in the state corresponding to or after time t2 in FIG. 8.

Next, upon determining that the motors have started operating, the processor 5 changes the level of the control signal C2 to an H level in order to switch ON the MOSFET 45*a* (step S203). As a result, power begins to be supplied to the thermal head 10, thereby making it possible to selectively heat the heating elements 10*a* in accordance with the printing data. Moreover, due to power beginning to be supplied to the thermal head 10 after it is confirmed that the motors have started operating, the capacitor 44 remains in a charged state while power is supplied to the thermal head 10. Therefore, even when the number of the heating elements 10*a* that are selected on the basis of the printing data is large and the thermal head 10 requires current of a greater magnitude than the power supply capacity of the AC adapter, it is possible to discharge the charge from the capacitor 44 in order to supply the necessary current to the thermal head 10. This eliminates the need to use divided printing to conserve current, thereby making it possible to print at higher speeds. In FIG. 8, the periods labeled "Discharge" between time t2 to t3 correspond to such periods in which the charge from the capacitor 44 is discharged while supplying power to the thermal head 10. At these times, although the charge stored in the capacitor 44 temporarily decreases due to the discharge of charge from the capacitor 44, the MOSFET 43*a* remains ON during these periods, and therefore the capacitor 44 is continuously being recharged. As a result, even though charge is discharged from the capacitor 44, the charge is quickly replenished due to the recharging, and therefore the charge of the capacitor 44 is actually maintained at a substantially constant level. Note that in FIG. 8, the changes in the charge of the capacitor 44 are slightly exaggerated in order to better illustrate the behavior described above.

When stopping operation of the thermal head 10 (YES in step S204), the processor 5 switches OFF the MOSFET 45*a* (step S205) in order to terminate the supply of power to the thermal head 10. This makes it possible to, when the thermal head 10 is not in use, terminate the supply of power to the thermal head 10 without terminating the supply of power to the stepping motor 12, regardless of the fact that the stepping motor 12 and the thermal head 10 both share the power supply circuit 40. This, in turn, makes it possible to prevent voltage from being unnecessarily applied to the thermal head 10, thereby making it possible to avoid failure of the thermal head 10 and extend the lifespan of the thermal head 10.

Figure 10:
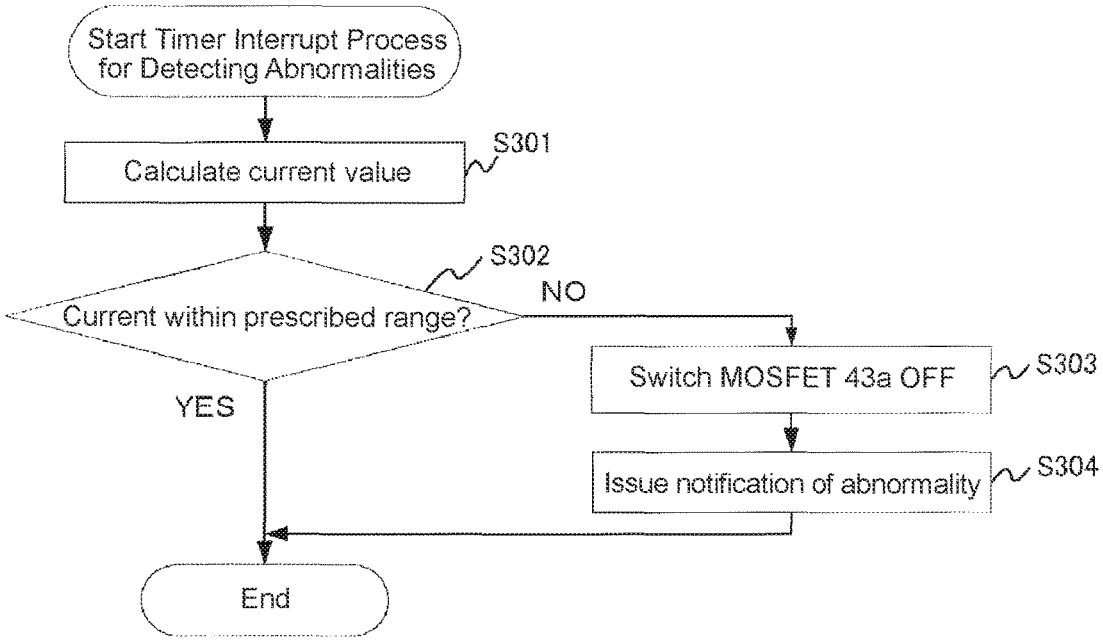
FIG. 10 is a flowchart of a timer interrupt process for detecting abnormalities.

FIG. 10 is a flowchart of a timer interrupt process for detecting abnormalities. Next, the timer interrupt process for detecting abnormalities performed by the processor 5 will be described in detail with reference to FIGS. 6 and 10. For example, the timer interrupt process for detecting abnormalities is configured to be executed at a prescribed time interval, which is determined in advance. It is preferable that the timer interrupt process for detecting abnormalities be configured to be executed during the period of continuous current supply starting from time t2 in FIG. 8.

Once the timer interrupt process for detecting abnormalities is started, the processor 5 first calculates the drain current value of the MOSFET 43*a* (step S301). Here, the processor 5 calculates the drain current value $I_{DS}$ by dividing the drain-source voltage value $V_{DS}$ of the MOSFET 43*a* (the output of the op-amp 46) by the drain-source resistance value $R_{DS}$ of the MOSFET 43*a*. Here, the resistance value at a standard temperature is used as the resistance value $R_{DS}$, for example. Furthermore, if the temperature of the MOSFET 43*a* can be measured, the resistance value at that measured temperature may be used.

After calculating the drain current value, the processor 5 determines whether the calculated drain current value is within a prescribed range (step S302). Here, the prescribed range of the current value is defined so as to not include at least abnormal current values at which the printing process should be stopped.

If the drain current value is within the prescribed range (YES in step S302), the processor 5 immediately ends the timer interrupt process for detecting abnormalities. Meanwhile, if the drain current value is outside of the prescribed range (NO in step S302), the processor 5 switches OFF the MOSFET 43*a* (step S303). Therefore, if an extremely large current flows due to a short-circuit or the like, for example, the supply of power to the head driver circuit 9 and the conveying motor driver circuit 11 is quickly stopped, which makes it possible to stop the printing process before the fuse melts, for example.

Next, the processor 5 controls the notification unit so as to notify the user of the abnormality in the printer 1 (step S304) and then ends the timer interrupt process for detecting abnormalities. This makes it possible for the user to ascertain that an abnormality has occurred in the printer 1.

Figure 11:
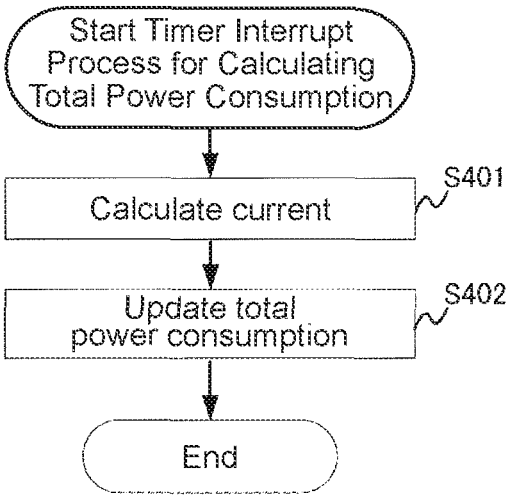
FIG. 11 is a flowchart of a timer interrupt process for calculating total power consumption.

FIG. 11 is a flowchart of a timer interrupt process for calculating total power consumption. Next, the timer interrupt process for calculating total power consumption, which is performed by the processor 5, will be described in detail with reference to FIGS. 6 and 11. For example, the timer interrupt process for calculating total power consumption is configured to be executed at a prescribed time interval, which is determined in advance.

Once the timer interrupt process for calculating total power consumption is started, the processor 5 first calculates the drain current value of the MOSFET 43*a* (step S401). This process is the same as the process in step S301 of FIG. 10.

Next, the processor 5 calculates and updates the total power consumption on the basis of the calculated drain current value (step S402). More specifically, the processor 5 calculates the power W1 ($=I_{DS}\times V1\times T1$) consumed since the previous interrupt process on the basis of the drain current value $I_{DS}$ calculated in step S401, the output voltage value V1 from the AC adapter 50, and the time interval T1 at which the interrupt process is executed, for example. Then, the calculated power W1 is added to the total power consumption WS to update the total power consumption WS (=WS+W1). This makes it possible to predict the state of the printer 1. For example, the temperature of the thermal head 10 may be predicted on the basis of this total power consumption, and then the printing process may be temporarily suspended or completely stopped in accordance with the predicted temperature. This makes it possible to prevent failures of the printer 1 in advance.

In the printer 1 according to the present embodiment, the power supply circuit 40 which supplies power to the thermal head 10 includes the capacitor 44, thereby making it possible to supply current of greater magnitude than the power supply capacity of the AC adapter to the thermal head 10. For example, if the output voltage of the AC adapter 50 is 24 V and the capacitance of the capacitor 44 is 4700 μF, discharging the capacitor 44 makes it possible to supply a current of 10 A for approximately 5 ms. Each current-conducting period of the thermal head 10 is relatively short (less than 1 ms, for example), and therefore using the charge stored in the capacitor 44 makes it possible to sufficiently provide the required current. This eliminates the need to use divided printing, thereby making it possible to print at higher speeds.

Moreover, in the printer 1, the power supply circuit 40 which supplies power to the stepping motor 12 includes the capacitor 44 and the switching circuit 43, and the switching circuit 43 is controlled so as to alternately switch the supply of current to the capacitor 44 on and off when starting operation of the stepping motor 12, thereby making it possible to inhibit flow of inrush currents of relatively large magnitude to the capacitor 44. This, in turn, makes it possible to prevent malfunctions and the like in the device.

Furthermore, in the printer 1, the capacitor 44 is arranged between the both conveying motor driver circuit 11 and head driver circuit 9 and the switching circuit 43, and when stopping operation of the stepping motor 12 after an operation for stopping the printer 1 is performed, the operation mode of the conveying motor driver circuit 11 is changed to the braking mode. Therefore, after the printing process is completed and the motors have stopped operating, at which time the capacitor 44 is no longer being charged, it is possible to reliably discharge any charge stored in the capacitor 44.

In addition, in the printer 1, the switching circuit 45 is arranged between the both conveying motor driver circuit 11 and switching circuit 43 and the head driver circuit 9, thereby making it possible to reduce propagation of noise from the head driver circuit 9 (which experiences larger currents than the conveying motor driver circuit 11) to the conveying motor driver circuit 11. This makes it possible to prevent the stepping motor 12 from stepping-out due to such noise. Moreover, when the thermal head 10 is not in use, the supply of power to the thermal head 10 can be terminated without terminating the supply of power to the stepping motor 12. This makes it possible to prevent voltage from being unnecessarily applied to the thermal head 10.

Moreover, in the printer 1, the printer 1 can be monitored on the basis of the signal from the op-amp 46, thereby making it possible to prevent failures of the printer 1 in advance. Furthermore, when an abnormality is detected in the printer 1, it is possible to quickly notify the user of the abnormality.

Embodiment 2

Figure 12:
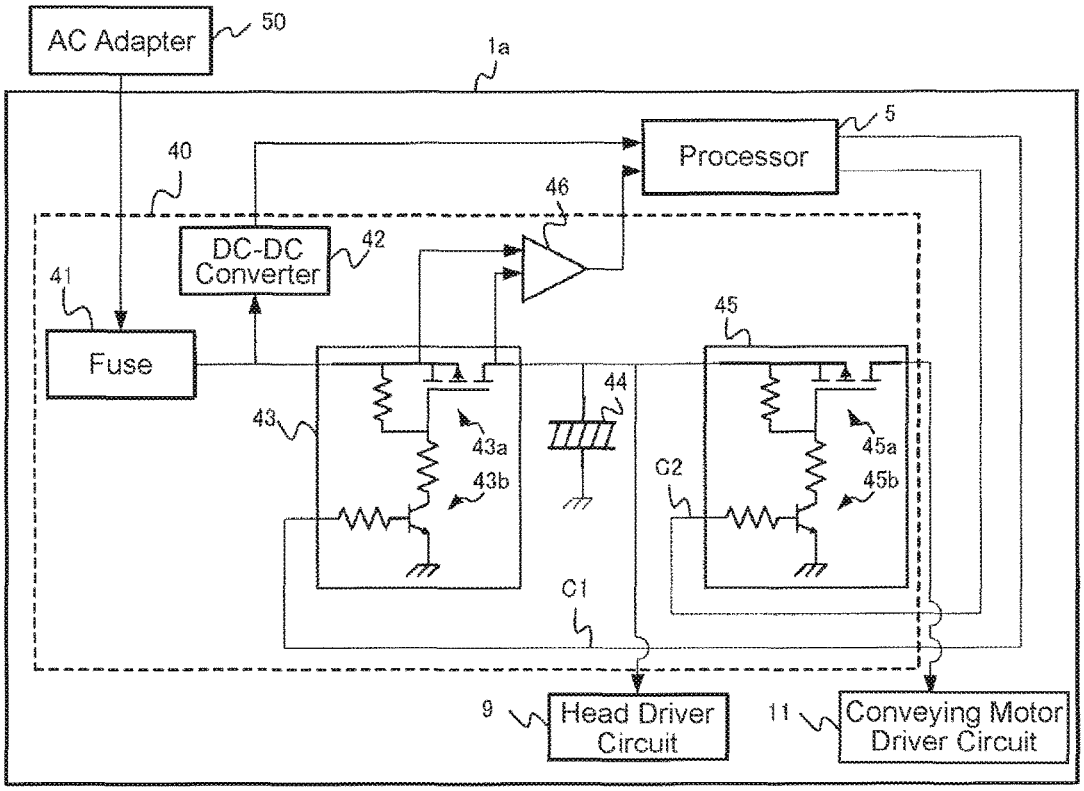
FIG. 12 is a block diagram illustrating a configuration of a power supply circuit 40 of a printer 1*a*.

FIG. 12 is a block diagram illustrating a configuration of a power supply circuit 40 of a printer 1*a* according to Embodiment 2. The printer 1*a* includes the power supply circuit 40, a processor 5, a head driver circuit 9, and a conveying motor driver circuit 11. The printer 1*a* is different from the printer 1 of Embodiment 1 in that a switching circuit 45 is arranged between the head driver circuit 9 and switching circuit 43 and the conveying motor driver circuit 11. The rest of the configuration is the same as in the printer 1.

Similar to the printer 1, the printer 1*a* performs the motor driving control process illustrated in FIG. 7, the timer interrupt process for detecting abnormalities illustrated in FIG. 10, and the timer interrupt process for calculating total power consumption illustrated in FIG. 11.

The printer 1*a* similarly makes it possible to supply current of greater magnitude than the power supply capacity of the AC adapter to the thermal head 10, which eliminates the need to use divided printing and thereby makes it possible to print at higher speeds. The printer 1*a* is also similar to the printer 1 in terms of inhibiting flow of inrush currents of relatively large magnitude to the capacitor 44 and thereby making it possible to prevent malfunctions and the like in the device. Moreover, after the printing process is completed and the motors have stopped operating, at which time the capacitor 44 is no longer being charged, it is possible to reliably discharge any charge stored in the capacitor 44. Furthermore, the printer 1*a* can be monitored to prevent failures of the printer 1*a* in advance, and when an abnormality is detected in the printer 1*a*, it is possible to quickly notify the user of the abnormality.

Embodiment 3

Figure 13:
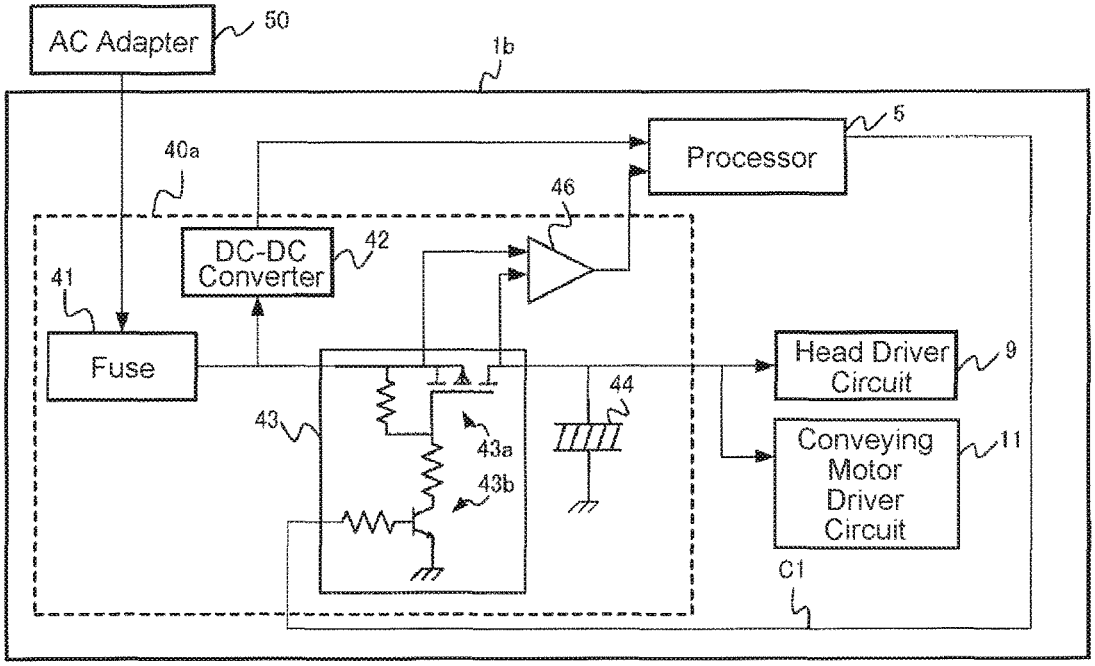
FIG. 13 is a block diagram illustrating a configuration of a power supply circuit 40*a* of a printer 1*b*.

FIG. 13 is a block diagram illustrating a configuration of a power supply circuit 40*a* of a printer 1*b* according to Embodiment 3. The printer 1*b* includes the power supply circuit 40*a*, a processor 5, a head driver circuit 9, and a conveying motor driver circuit 11. The printer 1*b* is different from the printer 1 of Embodiment 1 in that the printer 1*b* includes the power supply circuit 40*a* instead of the power supply circuit 40. The rest of the configuration is the same as in the printer 1. Moreover, the power supply circuit 40*a* is different from the power supply circuit 40 of Embodiment 1 in that the power supply circuit 40*a* does not include the switching circuit 45.

Similar to the printer 1 and the printer 1*a*, the printer 1*b* performs the motor driving control process illustrated in FIG. 7, the timer interrupt process for detecting abnormalities illustrated in FIG. 10, and the timer interrupt process for calculating total power consumption illustrated in FIG. 11.

The printer 1*b* makes it possible to achieve the same advantageous effects as in the printer 1*a*.

The embodiments described above are only examples intended to facilitate understanding of the invention, and the present invention is not limited to these embodiments. The printer and the method of controlling the printer can be modified and changed in various ways without departing from the scope of the claims.

For example, although in the embodiments above a printer 1 including an input unit 3 and a display unit 4 was described as an example, the printer may be a printer which does not include at least one of the input unit 3 and the display unit 4, or the printer may be a printer which receives printing data from an external device (such as a personal computer, for example) other than the printer 1. Moreover, although in the embodiments above the notification unit for issuing notifications of abnormalities was described as being the display unit 4 as an example, the notification unit is not limited to the display unit 4. For example, the notification unit may be an LED, and abnormality notifications may be issued by illuminating the LED or flashing the LED on and off. Moreover, the notification unit may be an audio output unit which outputs a warning sound or the like.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A printer, comprising:

a processor;

a thermal head driver circuit that drives a thermal head for printing on a printing medium;

a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, wherein the processor, when stopping operation of the printer, performs a control process of discharging the capacitor via the motor driver circuit and the motor.

2. The printer according to claim 1, wherein in the control process of discharging the capacitor when stopping operation of the printer, the processor sets the motor to a braking mode in order to put the motor in a state in which the motor no longer produces the power, thereby causing current to flow from the capacitor to the motor via the motor driver circuit.

3. The printer according to claim 1, wherein when the motor is to be driven, the processor controls the first switching circuit so as to alternately switch supply of current to the capacitor on and off to charge the capacitor.

4. The printer according to claim 1, further comprising:

a second switching circuit connected between a charging node of the capacitor, through which the first switching circuit charges the capacitor, and the thermal head driver circuit.

5. The printer according to claim 1, further comprising:

an amplifier circuit that amplifies a voltage drop caused by the first switching circuit, wherein the processor monitors the printer on the basis of an output signal from the amplifier circuit.

6. The printer according to claim 5, further comprising:

a notification unit that issues notifications, wherein the processor detects whether an abnormality occurs in the printer on the basis of the output signal from the amplifier circuit, and causes the notification unit to issue a notification of the abnormality when the abnormality is detected.

7. The printer according to claim 1, wherein the first switching circuit includes a semiconductor switching device.

8. The printer according to claim 4, wherein the processor, when stopping operation of the printer, causes the second switching circuit to cut off application of voltage to the thermal head driver circuit.

9. A method of controlling a printer performed by a processor in the printer, the printer including said processor; a thermal head driver circuit that drives a thermal head for printing on a printing medium; a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, the method comprising:

receiving an instruction to stop operation of the printer; and performing a control process of discharging the capacitor via the motor driver circuit and the motor upon the receipt of the instruction to stop operation of the printer.

10. The method of controlling the printer according to claim 9, further comprising:

when the motor is to be driven, controlling the first switching circuit so as to alternately switch supply of current to the capacitor on and off to charge the capacitor.

11. A non-transitory computer-readable storage medium having stored a program executable by a processor in a printer that includes said processor; a thermal head driver circuit that drives a thermal head for printing on a printing medium; a motor driver circuit that drives a motor configured to convey the printing medium; and a power supply circuit that includes a capacitor and a first switching circuit to charge the capacitor, the power supply circuit supplying electrical power to the thermal head driver circuit and the motor driver circuit via the capacitor, the program causing the processor to execute the following processes:

receiving an instruction to stop operation of the printer; and performing a control process of discharging the capacitor via the motor driver circuit and the motor upon the receipt of the instruction to stop operation of the printer.

* * * * *